US005448807A

United States Patent [19]

Herrington, Jr.

[11] Patent Number: 5,448,807

[45] Date of Patent: Sep. 12, 1995

[54] PLASTIC END CLIPS FUSED TO PLASTIC ZIPPER

[75] Inventor: F. John Herrington, Jr., Holcolm, N.Y.

[73] Assignee: Mobil Oil Corporation, Fairfax, Va.

[21] Appl. No.: 74,576

[22] Filed: Jun. 10, 1993

[51] Int. Cl.[6] ..... A44B 19/00

[52] U.S. Cl. ..... 24/399; 24/387; 24/436

[58] Field of Search ..... 24/399, 400, 389, 388, 24/390, 384, 435, 436; 383/59, 63, 64

[56] References Cited

U.S. PATENT DOCUMENTS

| | | | |
|---|---|---|---|
| 3,259,951 | 7/1966 | Zimmerman | 24/201 |
| 3,389,441 | 6/1968 | Heimberger | 24/389 |
| 3,686,719 | 8/1972 | Johnston et al. | 24/436 |
| 3,790,992 | 2/1974 | Herz | 24/201 C |
| 3,972,095 | 8/1976 | Kandou | 24/436 |
| 4,890,935 | 1/1990 | Ausnit et al. | 383/59 |
| 5,007,143 | 4/1991 | Herrington | 24/400 |
| 5,067,208 | 11/1991 | Herrington et al. | 24/400 |
| 5,088,971 | 2/1992 | Herrington | 493/203 |
| 5,131,121 | 7/1992 | Herrington et al. | 24/436 |
| 5,161,286 | 11/1992 | Herrington et al. | 24/387 |

FOREIGN PATENT DOCUMENTS

| | | | |
|---|---|---|---|
| 2752703 | 6/1978 | Germany | 24/436 |

*Primary Examiner*—Victor N. Sakran
*Attorney, Agent, or Firm*—Alexander J. McKillop; Malcom D. Keen; L. Gene Wise

[57] ABSTRACT

A plastic clip is located at each end of a plastic zipper of a thermoplastic bag and fused with the ends of the profile elements of the zipper into a single mass by melting the clip to the zipper material.

13 Claims, 1 Drawing Sheet

PLASTIC END CLIPS FUSED TO PLASTIC ZIPPER

BACKGROUND OF THE INVENTION

The present invention relates to improvements in plastic reclosable fasteners or zippers with sliders for opening and closing the zippers on plastic bags and the like and particularly to the provision of plastic end clips at the ends of the plastic zipper to seal the ends of the zipper and to provide stops to retain the slider on the zipper.

Plastic reclosable fasteners or zippers with sliders are well known in the art. The plastic zippers have profiles and include a pair of male and female fastener elements in the form of reclosable interlocking rib and groove profile elements for cooperation with a slider for opening and closing the rib and groove elements. In the manufacture of thermoplastic film bags, a pair of these male and female plastic profile elements extend along the mouth of the bags and these male and female elements are adapted to be secured in any suitable manner to the flexible walls of the thermoplastic film bags. These profile elements may be integral marginal portions of such walls or they may be extruded separately and thereafter attached by a fin to the walls along the mouth of the bag. Various arrangements have been utilized heretofore to prevent the slider from sliding off the ends of the zipper. In one of the more conventional arrangements the slider included a separator finger that extends down between the integral locking rib and groove elements as the slider is moved from one edge of the bag to the other edge of the bag. When the bag is opened, the only thing to stop the slider was the side seam at the edge of the bag when the slider finger comes into contact with it. This prior art is described in U.S. Pat. No. 3,790,992—Herz. In that patent there is disclosed an arrangement wherein the heat seals that join the rib and groove elements are wider at one edge than the second edge of the bag and the wider seal is of a width at least equal to the length of the slider from its closing end of the finger so that the slider will remain fully on the bag at the end of its travel when opening the bag. The patent points out that these seal areas provide stops for the slider. Another arrangement for providing stops at the end of the zipper is disclosed in U.S. Pat. No. 3,259,951—Zimmerman. In that patent the opposite ends of the interlocking or mating strips are permanently joined or sealed to each other at the ends with the stop members sealed between the opposite ends of these members to stop the longitudinal movement of the slider therealong. U.S. Pat. Nos. 5,088,971—Herrington and 5,131,121—Herrington et al disclose end stops at the opposite ends of the reclosable fastener where the end stops are formed from the material at the opposite ends of the reclosable fastener and protrude transversely from the fastener a distance adequate to engage the slider and prevent movement of the slider passed the respective ends of the bag. With this arrangement the size of the end stops is limited by the amount of material in the ends of the fastener. Another prior art arrangement is shown in U.S. Pat. No. 5,161,286—Herrington et al. In this patent the end clamp members are located at the opposite ends of the reclosable fastener and the end clamp members are connected together by a flexible strap which extends over the top of the zipper and the rivet extends through the clamp members and the sidewalls of the bag beneath the profile elements of the zipper to secure the clamp members to the bag.

It would be desirable to provide the plastic bags wherein the zipper is terminated by end clips and the zipper and end clips fused into a single mass which creates a stronger seal because it is not limited to the cross sectional area of the profile elements and does not rely on a rivet for the strength of the seal.

The present invention provides a strong and leakproof joint and is an improvement on the end stops for plastic reclosable fastener disclosed in U.S. Pat. Nos. 5,088,591, 5,131,121 and in 5,161,286 of F. J. Herrington and Eric A. St. Phillips which disclosure is incorporated herein by this reference thereto.

SUMMARY OF THE INVENTION

It is an object of the present invention to provide a plastic bag having a plastic zipper with improved means for attaching the ends of the two zipper elements together so they are strong and leakproof and capable of retaining a slider on the zipper. The present invention relates to the manufacture of thermoplastic bags and the like having a reclosable fastener extending along the mouth of the bag, the fastener comprising a pair of flexible plastic strips secured to the facing sidewalls of the bag and having a reclosable interlocking male and female profile elements on the respective strips. The improvement comprises a leakproof reclosable fastener having end clip means located at the opposite ends of the reclosable fastener, each of the end clip means comprising a plastic strap member extending over the top of the reclosable fastener and fused with the ends of the male and female profile elements into a single mass so they are leakproof and integral with the strap member. Each strap member and the male and female profile elements are made of compatible plastic material so they can be fused together. In accordance with another aspect of the invention the thermoplastic bags include a slider straddling the fastener for opening or closing the fastener. Each of the strap members after fusion to the male and female profile elements of the reclosable fastener project outwardly therefrom and are engageable with the slider for preventing the slider from moving past the ends of the reclosable fastener.

The present invention also relates to the method of manufacturing leakproof reclosable fastener for thermoplastic bags. The method comprises the steps of positioning end clip means at the opposite ends of the male and female profile elements of the reclosable fastener, each of the end clip means comprising a plastic strap member. Folding the plastic strap member over the top of the male and female profile elements, each of the strap members and the male and female profile elements being made of compatible plastic material so they can be fused together, and fusing the plastic strapped member with the ends of the male and female profile elements into a single mass so they are leakproof and integral with the strap members. Fusion may be accomplished by the application of heat energy or ultrasonic energy.

DESCRIPTION OF THE PREFERRED EMBODIMENT

Figure 1:
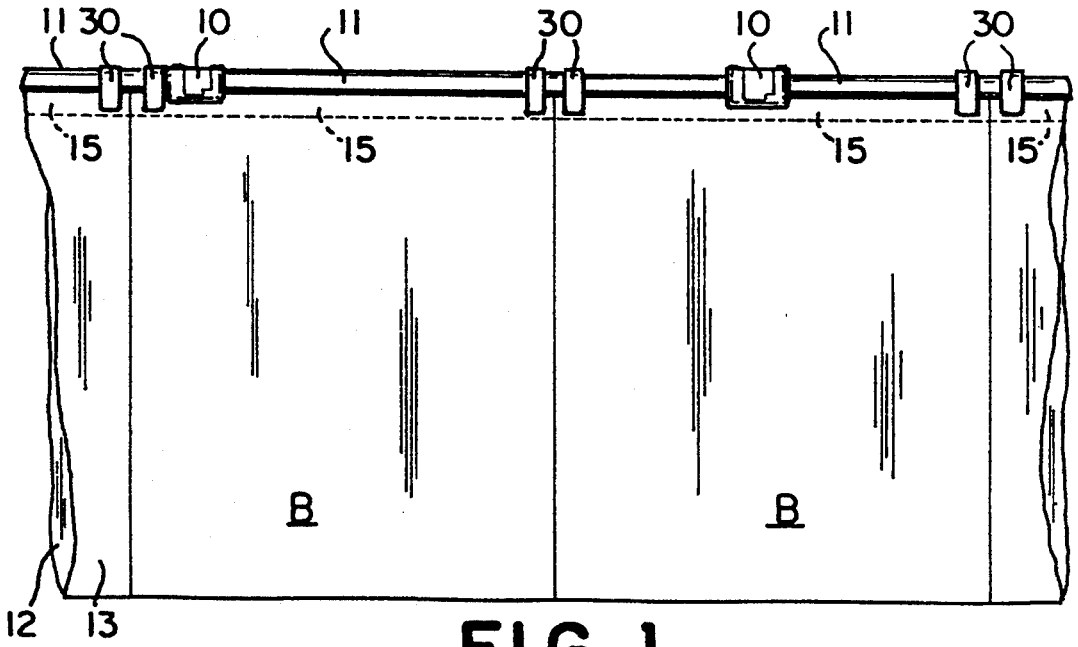
FIG. 1 is an elevational view of the series of thermoplastic bags manufactured in accordance with the present invention.

Referring to FIG. 1 there is illustrated a series of thermoplastic bags B each having a plastic slider 10 and a profiled plastic reclosable fastener or zipper 11 with end termination clips 30 embodying the present invention. The slider 10 and zipper 11 are particularly suited for thermoplastic bags and the like. While various types of sliders and zippers maybe used with the new end termination clips 30, the slider 10 has been illustrated as of the type disclosed and claimed in U.S. Pat. No. 5,067,208—Herrington et al entitled "Plastic Reclosable Fastener with Self-Locking Slider" and the zipper 11 has been illustrated as of the type disclosed and claimed in U.S. Pat. No. 5,007,143—Herrington entitled "Rolling Action Zipper Profile and Slider Therefor". As shown in FIG. 1 the slider 10 is assembled on the zipper 11 at the top edge or mouth of the thermoplastic bag B. The bag B may be made of any suitable thermoplastic film such for example as polyethylene or polypropylene or equivalent material. The zipper 11 preferably is made from the same plastic material as the bag B. The bag B is formed by a pair of flexible plastic sheets 12 and 13 joined at the bottom and having a top edge, with a pair of flexible plastic strips or fins 14 and 15 having separable plastic means extending along the length thereof comprising reclosable interlocking male and female profile elements in the form of rib and groove elements 16 and 17 on the respective strips to form the zipper 11. The strips 14 or 15 may be extruded separately and attached to the respective sides of the bag mouth or the strips 14 and 15 may be extruded integral with the sides of the bag mouth. The strips 14 and 15 include profiled tracks 18 and 19 extending along the length thereof parallel to the rib and groove elements 16 and 17. The rib and groove elements, 16, 17 may have various complementary cross-sectional shapes. However, the shapes of the elements disclosed herein are such that they are closed by pressing the bottom of the elements together first and then rolling the elements to a closed position toward the top thereof. The cross-sectional shapes of the interlocking male and female elements having the rib and groove profile 16 and 17 and are the subject of the invention claimed in the aforesaid U.S. Pat. No. 5,007,143.

The slider 10 straddles the zipper 11 at the top of the bag B and is adapted for opening or closing the reclosable fastener elements 16 and 17 of the zipper 11. The slider 10 moves along the zipper 11 from one end to the other and includes a separator finger (not shown) which cooperates with the tracks 18 and 19, FIG. 2, to open and close the zipper. The slider 10 may be molded from any suitable plastic such for example as nylon, polypropylene, polystyrene, Delrin, or ABS.

Figure 2:
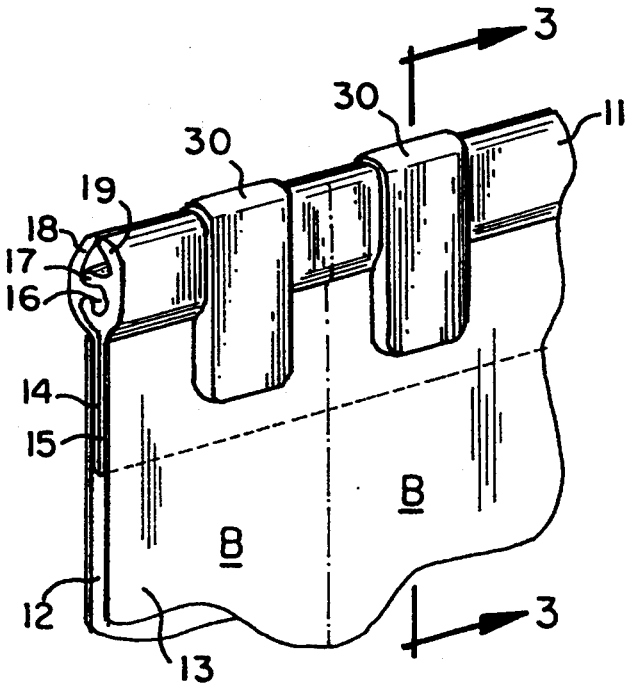
FIG. 2 is a perspective view of plastic end clips fused to the plastic zipper material.
Figure 3:
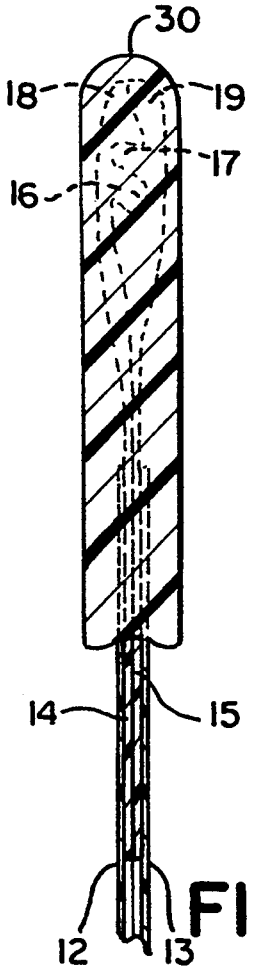
FIG. 3 is a cross-sectional view taken along the lines 3—3 in FIG. 2 showing the end clip extending over the top of the reclosable fastener and fused with the ends of the male and female profile elements into a single mass.

Referring to FIGS. 1 and 2 it will be seen that the opposite ends of the zipper 11 are provided with end clips, 30, 30. Each of the end clips 30 is identical and each end clip 30 comprises a strap member which wraps over the top of the zipper 11 in substantially U-shaped form. As shown in FIG. 2 there is illustrated a pair of typical end clips 30 that form the right end of one bag and the left end of the next bag. For ease in manufacture of the bags, the end clips 30 can be formed as a single unit, with the two clips attached by a tie bar made of the same material, or they may be separate clips. Each clip 30 is wrapped around the profile elements at the ends of the bag and then sealed along with the profile ends to form a fused mass. The clips 30 may be held by an insertion device while they are sealed to the zipper, or the clips may be inserted so that they hold themselves in place while the clips are subsequently heated and sealed. To hold the clips in place by themselves, the clips may be provided with an integral pin that penetrates the zipper fin. The sealing operation may be performed by a pair of heated jaws or by ultrasonic energy. The sealing energy must be adequate to fuse the plastic strap member 30 with the ends of the male and female profile elements into a single mass as best shown in FIG. 3, so that they are leakproof and integral with the strap member. It is necessary that the strap member or clip 30 and zipper 11 be made of compatible materials that can be fused together. For example, both the clip 30 and the zipper 11 can be made of polyethylene, or the zipper 11 can be made of polyethylene while the clip 30 is an ethylene-propylene copolymer.

It will be noted that the end clips 30 after being fused to the zipper extend outwardly from the zipper and thus are engageable with the slider 10 for preventing the slider from moving past the ends of the reclosable fastener or zipper 11. Also, by providing additional thermoplastic material at the ends of the zipper elements, this insures that when the clip and zipper material are melted and fused together, the joint formed therebetween will be strong and leakproof. The end stops formed by the end clips 30 in the present invention represent an improvement over the end stops disclosed in U.S. Pat. Nos. 5,088,971 and 5,131,121. In those patents the end stops were formed solely by fusing the ends of the profile elements in the zipper and thus the amount of material available for forming the end stops and sealing the profile elements of the zipper was limited to the material in the zipper elements. Such a limitation is eliminated in the present invention by the use of the additional end clips 30. The method of installing the end clips 30 disclosed herein also eliminates the need for a pre-seal on the plastic strips 14 and 15 at the side seal locations to reduce the material thickness before installing the end clips 30 as described in the aforesaid U.S. Pat. No. 5,161,286. The end clips 30 in the present invention eliminate the punching of the hole in the bag walls and zipper fins to receive the rivet disclosed in U.S. Pat. No. 5,161,286 thereby eliminating a source for leakage. After the end clips 30 have been sealed to the ends of the bags, a side seal is formed across the thermoplastic sheets between the bags and the bags are severed from each other as shown in FIG. 1.

While a preferred embodiment of the invention has been described and illustrated, it is to be understood that further modification thereof may be made within the scope of the appended claims without departing from the spirit of the invention.

What is claimed is:

1. In the manufacture of thermoplastic bags and the like having a reclosable fastener extending along the mouth of the bag, the fastener comprising a pair of flexible plastic strips secured to the facing side walls of the bag and having reclosable interlocking male and female profile elements on the respective strips, the improvement in a leakproof reclosable fastener comprising:

end clip means located at the opposite ends of said reclosable fastener, each of said end clip means comprising a plastic member extending over the top of said reclosable fastener and fused with the ends of the male and female profile elements into a single mass so they are leakproof and integral with the plastic member, each said plastic member and said male and female profile elements being made of compatible plastic materials so that they can be fused together.

2. The improvement of claim 1 wherein said plastic members and said male and female profile elements are all made of polyethylene.

3. The improvement according to claim 1 wherein said male and female profile elements are made of polyethylene and said members are made of an ethylene-propylene copolymer.

4. The improvement of claim 1 wherein said end clip means comprises a plastic strap member.

5. The improvement of claim 1 wherein said end clip means comprises a substantially U-shaped plastic member.

6. The improvement of claim 1 wherein said end clip means after fusion to the male and female profile elements project outwardly therefrom.

7. In the manufacture of thermoplastic bags and the like having a reclosable fastener extending along the mouth of the bag, and a slider straddling the fastener for opening or closing the fastener, the fastener comprising a pair of flexible plastic strips secured to the facing side walls of the bag and having reclosable interlocking male and female profile elements on the respective strips, the improvement in a leakproof reclosable fastener comprising:

end clip means located at the opposite ends of said reclosable fastener, each of said end clip means comprising a plastic strap member extending over the top of said reclosable fastener and fused with the ends of the male and female profile elements into a single mass so they are leakproof and integral with the strap member, each said strap member after fusion to said male and female profile elements projecting outwardly therefrom and being engageable with the slider for preventing the slider from moving past the ends of the reclosable fastener, said strap member and said male and female profile elements being made of compatible plastic materials so that they can be fused together.

8. The improvement of claim 7 wherein said straps and said male and female profile elements are all made of polyethylene.

9. The improvement according to claim 7 wherein said male and female profile elements are made of polyethylene and said members are made of an ethylene-propylene copolymer.

10. In the manufacture of thermoplastic bags and the like having a reclosable fastener extending along the mouth of the bag, the fastener comprising a pair of flexible plastic strips secured to the facing sidewalls of the bag and having reclosable interlocking male and female profile elements on the respective strips, the method of making a leakproof reclosable fastener comprising the steps of:

positioning end clip means at the opposite ends of the male and female profile elements of the reclosable fastener, each of the end clip means comprising a plastic member extending over the top of the male and female profile elements, each of said plastic members and said male and female profile elements being made of compatible plastic materials so they can be fused together, and fusing the plastic member with the ends of the male and female profile elements into a single mass so they are leakproof and integral with each other.

11. The method according to claim 10 wherein the plastic strap member and the ends of the male and female profile elements are fused into a single mass by melting the plastic strap member to the male and female profile elements by the application of heat energy.

12. The method according to claim 10 wherein the plastic strap member and the ends of the male and female profile elements are fused into a single mass by melting the plastic member to the male and female profile elements by the application of ultrasonic energy.

13. The method according to claim 10 wherein said plastic member is a plastic strap folded over the top of the male and female profile elements.

* * * * *